United States Patent [19]

Miggins

[11] Patent Number: 4,500,745

[45] Date of Patent: Feb. 19, 1985

[54] HYBRID ELECTRICAL INSULATOR BUSHING

[75] Inventor: Michael R. Miggins, LeRoy, N.Y.

[73] Assignee: Interpace Corporation, Purchase, N.Y.

[21] Appl. No.: 471,780

[22] Filed: Mar. 3, 1983

[51] Int. Cl.[3] ..... H01B 17/28; H01B 17/34

[52] U.S. Cl. ..... 174/31 R; 174/143

[58] Field of Search ..... 174/11 BH, 12 BH, 31 R, 174/143

[56] References Cited

U.S. PATENT DOCUMENTS 2,924,264 2/1960 Imhof ..... 174/143 X

*Primary Examiner*—Laramie E. Askin

*Attorney, Agent, or Firm*—Charles E. Baxley

[57] ABSTRACT

A bushing for insulating a conductor in a high-voltage electrical transmission system is fabricated of paper and metallic foil disposed as coaxial layers about the conductor. At one end of the bushing, the paper is impregnated with oil. At the opposite end of the bushing, the paper is impregnated with a resin which cures to a solid form. The paper, oil and resin serve as electrical insulators, while the metallic foil serves to disperse uniformly the electric field. A mounting flange is positioned on an enclosing casing for setting the resin end of the bushing into the housing of an electrical apparatus to which the bushing may be mounted so as to prevent contamination of the interior of the housing with the oil.

10 Claims, 1 Drawing Figure

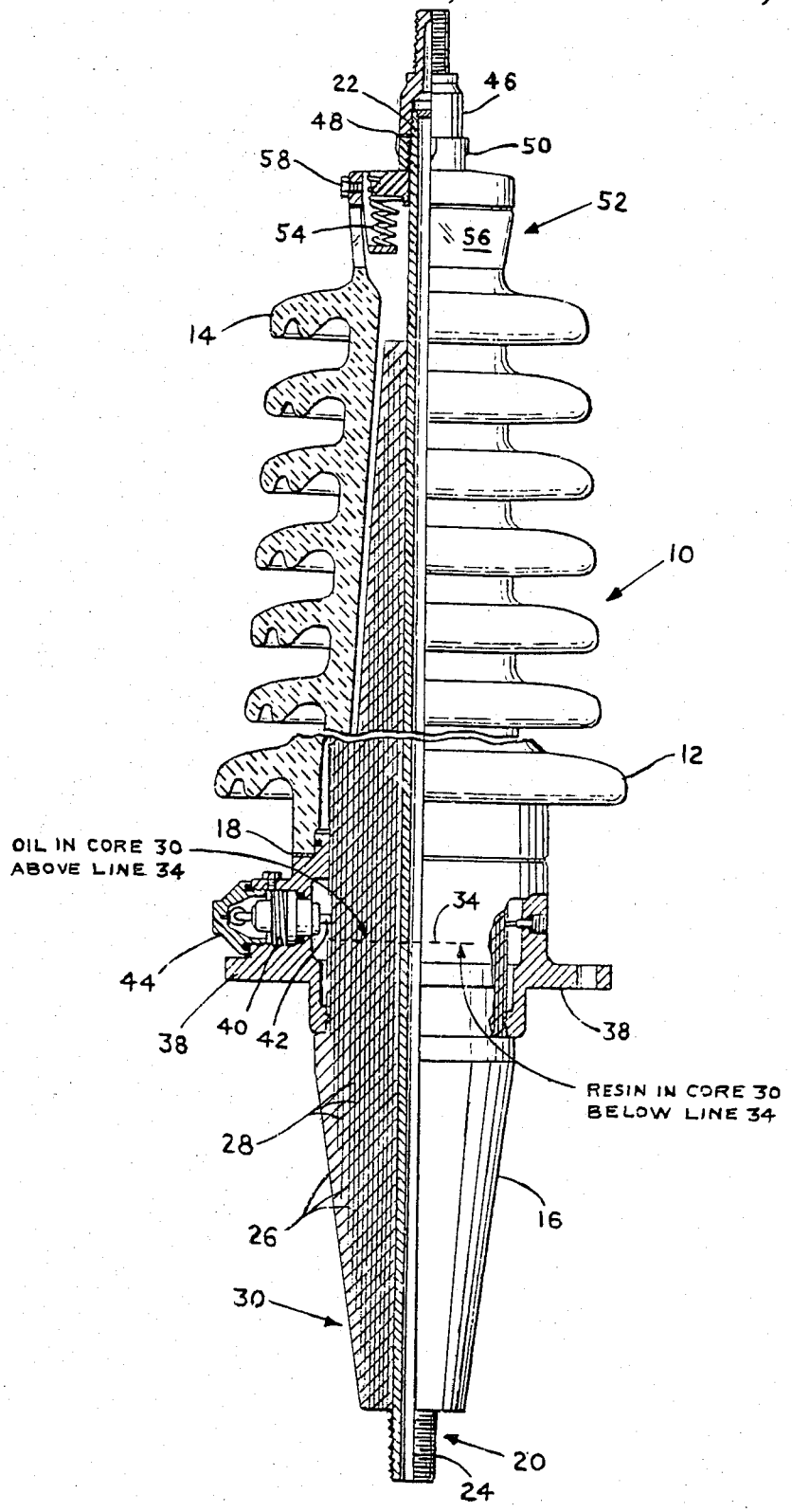
22
46
48
50
58
52
54
56
14
10
12
18
OIL IN CORE 30
ABOVE LINE 34
34
44
38
40
42
38
RESIN IN CORE 30
BELOW LINE 34
28
16
26
30
20
24

HYBRID ELECTRICAL INSULATOR BUSHING

BACKGROUND OF THE INVENTION

This invention relates to high-voltage electrical transmission systems, and more particularly, to an electrical bushing through which an electrical conductor is brought into an electrical apparatus.

In construction of systems for the transmission of electric power, provision is made for connection of electrical conductors to equipment encased in metallic housings. Such a conductor is brought through an aperture in the housing via an insulating bushing. Due to the high voltage involved in transmission of electric power, which voltage can be on the order of hundreds of thousands of volts, special construction features are employed in fabricating the bushing.

Pressurized gas, particularly sulfur hexafluoride, $SF_6$, has been used to provide the insulation. Also laminates of paper and metallic foil have been employed to provide a more uniform distribution of the electric field, the uniform distribution permitting a smaller physical size to the bushing while preventing arcing of electricity. The pressurized gas is not used in bushings for service above a few hundred thousand volts, above the 345 kV class, because the required gas pressure is so great as to pose a hazard to personnel and equipment. In the laminated structure, the paper is usually impregnated with some material such as epoxy resin or mineral oil to increase the dielectric strength of the structure.

The resin and the oil introduce further problems. In the case of the oil in the bushing, there is the threat of contamination of the $SF_6$ used as a dielectric in the equipment being entered by the bushing, and resultant fouling of the filtration system used in removal of moisture and byproducts of the gas. The resin presents manufacturing problems in that, due to high viscosity of the resin, it is difficult to impregnate completely the paper with the resin. Also, large resin castings tend to develop cracks during curing of the resin. Thus, the resin is limited to bushings of smaller physical size than that which would be used above the 200-300 kV range. An exemplary form of the laminate structure with resin interposed between cylindrical metallic sheets is disclosed in the U.S. Pat. No. 3,394,455 of Grimmer.

SUMMARY OF THE INVENTION

The foregoing problems are overcome and other advantages are provided by a bushing incorporating the invention for use in the transmission of electrical power at various voltages, including voltages above the 345 kV range. The construction of the bushing inhibits the contamination of the $SF_6$ gas within the equipment using the bushing by either rainwater or oil.

In accordance with the invention, the bushing has a laminated form with a core of interleaved laminae of paper and metallic foil arranged in a generally cylindrical array around a longitudinal central electrical conductor. The radial spacing of each lamina from the conductor may be approximately constant, as in a circular cylinder, or slowly varying as in a spiral cylindrical segment. The impregnation of the paper is accomplished in a hybrid form wherein a portion of the paper is impregnated with resin and the remainder is impregnated with oil. The resin is applied at one end of the core of the bushing and then percolates axially along the core to impregnate an end portion thereof with the resin. The remaining portion of the core is impregnated with the oil. When affixing the bushing within the aperture of a housing of electrical equipment, the end with the resin protrudes into the housing while the end with the oil remains outside the housing. Thereby, there can be no contamination of insulating gas within the equipment by the oil of the bushing.

To facilitate the impregnation of the paper with the resin, a crepe paper is utilized. The crepe introduces voids which draw the resin, and also provides for relaxation of stresses developed during curing of the resin. In order to fill the bushing to the desired amount, the core is advantageously positioned vertically in a mold having an entrance port at the bottom for the entry of the resin. A vertical pipe connects with the port and rises outside the mold to a height equal to the level at which the resin is to fill. Thereby, upon application of the resin to the mold via the pipe, the resin rises within the core to the height of the pipe. The mold is then heated to cure the resin. The remaining portion of the core is filled with the oil by conventional means. The portion of the core with the oil therein is enclosed within an electrically insulating casing, preferably a porcelain case which may have weather sheds.

BRIEF DESCRIPTION OF THE DRAWING

The aforementioned aspects and other features of the invention are explained in the accompanyng drawing which shows a longitudinal view, partially in section, of a bushing constructed in accordance with the invention.

DETAILED DESCRIPTION

As shown in the drawing, a bushing 10 includes an upper porcelain case 12 having weather sheds 14, and a lower portion 16 of hardened resin abutting a flange 38, which in turn abuts the case 12 at a gasket 18. An electrically conducting rod 20 of a metal, such as copper, passes longitudinally through the bushing 10 and has an upper terminal 22 and a lower terminal 24 which extend from opposite ends of the bushing 10. Sheets of metallic foil 26 are interleaved with paper sheets 28 in an array of coaxial cylindrical members forming a core 30 which surrounds the rod 20.

In accordance with the invention, the lower portion of the core 30 is filled with an epoxy resin up to a fill line 34. Upon curing, the resin hardens to form the lower portion 16 of the bushing 10. The upper portion of the core 30 is filled with an insulating oil such as a hydrocarbon or mineral oil. The lower portion 16 is provided with a mounting flange 38 whereby the bushing 10 is secured to a housing of electrical equipment (not shown). The fill line 34 is above the flange 38 so that the oil cannot come in contact with any gas which may be within the equipment. The foregoing design avoids a problem found in conventional oil-filled bushings wherein there is oil held below the flange 38 and within a lower porcelain casing which might leak oil into the gas atmosphere in the housing of the electrical equipment. The flange 38 is metallic to provide electrical contact with the foregoing housing. Electrical contact with an outer sheet of the foil 26 is attained via a metallic spring-loaded plug 40 threadedly mounted to the flange 38 and having a tooth 42 which passes through an aperture of a paper sheet 28 to contact the outer sheet of the foil 26. A cover and spring assembly 44 maintain pressure of the tooth 42 against the foil 26.

The top of the case 12 terminates in a cap 46 having a gasket 48 to provide an oil-tight seal. The cap 46 engages with screw threads at the end of the rod 20 and, upon rotation, advances along the rod 20 to urge a collar 50 and a spring housing 52 against the body of the case 12 to tighten the case 12 against the gasket 18 which in turn presses against the flange 38 to urge the flange 38 against the lower portion 16, the latter being provided with a projecting step to abut with the flange 38. Springs 54 (one of which is shown in the figure) of the housing 52 maintain the requisite pressure against the gasket 18 while allowing for dimensional changes due to variations in temperature. The housing 52 includes a transparent wall 56, which may be fabricated of glass, for viewing the level of oil within the case 12. Also included within the housing 52 is a screw-type fitting 58 for filling the case 12 with oil.

In the manner of constructing the bushing 10, the core 30 is first formed by winding the paper sheet 28 about the rod 20 in the conventional bushing fabrication fashion. Also, according to known procedures sections of foil 26 are set upon the paper sheets 28 during the winding process, the sections of foil 26 being spaced apart by the paper sheets 28 so as to build up insulated layers of the foil 26 in an arrangement analagous to the plates of a capacitor. The width of a section of foil 26 approximates the circumference of the core 30 so that each section of foil 26 has a spiral form when viewed along the axis of the core 30. The sections of the foil 26 which are disposed along the outer portions of the core 30 are provided with a reduced length as measured in the axial direction. Further, the core 30 is provided with a taper in circumference by trimming the paper at the ends, with the widest portion of the core 30 being located about the flange 38.

The core 30 is then placed in a mold (not shown) having an inlet at the bottom adjacent the bottom end of the core 30. Liquid formulated epoxy resin is then fed into the mold via the inlet and allowed to percolate upwards through the core 30 so as to saturate the paper sheets 28. The sheets 28 are preferably formed of crepe paper so as more readily to draw the liquid resin. To insure that the resin rises to the desired height, the line 34, a pipe (not shown) may be oriented vertically alongside the mold and connected with the inlet. The height of the pipe is the same as the fill line 34, so that upon filling the mold with the resin via the pipe, the resin rises only to the height of the pipe. Thereafter, the resin is heated to cure and become hardened, the resultant rigid structure being the lower portion 16 of the bushing 10. Because the lower portion 16 is to be inserted within electrical equipment (not shown) and thereby shielded from the erosion by weather, the epoxy resin thereof need not be shielded by a porcelain case as is the upper portion of the bushing 10.

The construction of the bushing 10 then continues with a filling of the upper portion of the core 30 with the oil, this being accomplished by immersing the core 30 in the oil. The cured resin is impervious to the oil and, accordingly, can be immersed in the oil bath so as to simplify the procedure for drawing oil into the paper sheets 28 of the upper portion of the core 30. Also, during the filling of the core 30 with the resin and the oil, it is advantageous to perform such filling operations in vacuo so as to more completely fill all of the voids. Oil is able to enter the spaces between the sections of foil 26 by means of the paper sheets 28 which extend outwardly from the array of the foil sections along the axial direction of the core 30, as well as extending through the spaces between the overlapping edges of the foil sections at the beginning and the end of each spiral. Furthermore, if desired, the sheets of foil 26 can be fabricated with perforations, in the manner of a mesh, so as to provide still further entry points for the oil whereby the oil can be drawn into the paper between the sections of foil.

The construction of the bushing 10 is completed by enclosing the core 30 in the case 12, and then filling the gap between the case 12 and the upper portion of the core 30 with the oil by means of the fitting 58. An air space is left within the housing 52 to allow for thermally induced expansion of the oil. The bushing 10 is then ready for use in a high-voltage transmission system.

The invention also applies to bushings fabricated with a different method of construction. For example, the construction may be attained by a method wherein use is made of a multiplicity of conducting elements composed of conducting ink printed in a herringbone fashion directly onto the insulating paper. The core is formed by winding this preprinted sheet and a plain non-printed sheet simultaneously on the stud. The printed sheet forms the capacitor layers while the plain sheet provides the necessary insulation between what would otherwise be adjacent conducting elements. In yet a further method of construction used for polymeric type bushings, preformed insulating cylinders of appropriate diameters and lengths are stacked around the center conductor forming a series of concentric cylinders. The resulting assembly is then impregnated with appropriate epoxy material. Both of these methods are suitable for use in constructing the invention of the hybrid bushing.

It is to be understood that the above-described embodiment of the invention is illustrative only and that modifications thereof may occur to those skilled in the art. Accordingly, this invention is not to be regarded as limited to the embodiment disclosed herein, but is to be limited only as defined by the appended claims.

I claim:

1. An electrical bushing comprising:

a core formed of sheets of electrically conducting material separated by electrically insulating material, said sheets of electrically conducting material being interleaved with and, coaxially disposed with the electrically insulating material;

an insulating casing enclosing an end of said core;

an electrically conducting rod traversing said core, and extending from an end of said core to form a terminal; and wherein said insulating material includes a cured resin at one end of said core, and an insulating oil at a second end of said core within said casing; said resin being absent from said second end of said core, and said oil being absent from said one end of said core.

2. An electrical bushing comprising:

a core formed of sheets of electrically conducting material and sheets of electrically insulating material, said sheets of electrically conducting material being interleaved with and coaxially disposed with said sheets of electrically insulating material;

an insulating casing enclosing an end of said core;

an electrically conducting rod traversing said core, and extending from an end of said core to form a terminal; and wherein said sheets of insulating material include a cured resin at one end of said core, and an insulating oil at a second end of said core within said casing; said resin being absent from said second end of said core, and said oil being absent from said one end of said core.

3. A bushing according to claim 2 wherein said sheets of electrically conducting material of said core are metallic foils.

4. A bushing according to claim 3 wherein said sheets of electrically insulating material of said core comprise sheets of paper.

5. A bushing according to claim 4 wherein said sheets of paper are impregnated with said resin and said oil.

6. A bushing according to claim 5 further comprising a mounting flange disposed traversely of a longitudinal axis of said bushing, and wherein said oil is disposed to one side of said flange to prevent entry of said oil into an equipment to which said bushing may be mounted by said flange.

7. An electrical bushing comprising:

a core constructed of a set of coaxial preformed cylinders of electrically conducting material, said core including electrically insulating material interspersed with said cylinders;

an insulating casing enclosing an end of said core;

an electrically conducting rod traversing said core, and extending from an end of said core to form a terminal; and wherein said insulating material includes a cured resin at one end of said core, and an insulating oil at a second end of said core within said casing; said resin being absent from said second end of said core, and said oil being absent from said one end of said core.

8. An electrical bushing comprising:

a core formed of sheets of electrically insulating material disposed coaxially about an axis of said core, said core including electrically conducting material interleaved with said sheets of insulating material and formed directly onto part of the sheets of insulating material by use of a conducting ink or paint;

an insulating casing enclosing an end of said core;

an electrically conducting rod traversing said core, and extending from an end of said core to form a terminal; and wherein said sheets of insulating material include a cured resin at one end of said core, and an insulating oil at a second end of said core within said casing; said resin being absent from said second end of said core, and said oil being absent from said one end of said core.

9. A bushing for insulating an electrical conductor comprising:

a core formed of sheets of electrically conducting material and sheets of electrically insulating material, said sheets of electrically conducting material being interleaved with and coaxially disposed with said sheets of electrically insulating material, said core being disposed about a conductor;

said sheets of electrically insulating material extending from one end portion of said core to a second end portion of said core; and wherein said sheets of electrically insulating material in said one end portion are imbedded in a solid insulant, and said sheets of electrically insulating material in said second end portion are immersed in a liquid insulant; said solid insulant being absent from said second end portion, and said liquid insulant being absent from said one end portion.

10. A bushing according to claim 9 wherein said solid insulant is a cured resin, and said liquid insulant is an oil.

* * * * *